US006861606B2

(12) United States Patent
Ribeiro et al.

(10) Patent No.: US 6,861,606 B2
(45) Date of Patent: Mar. 1, 2005

(54) SWITCH ACTUATOR MECHANISM

(75) Inventors: Manuel Fernando Vidal Ribeiro, Germiston (ZA); Carlos Alberto Ferreira, Boksburg (ZA)

(73) Assignee: Circuit Breaker Industries LTD, Elandsfontein (ZA)

( * ) Notice: Subject to any disclaimer, the term of this patent is extended or adjusted under 35 U.S.C. 154(b) by 0 days.

(21) Appl. No.: 10/246,417

(22) Filed: Sep. 19, 2002

(65) Prior Publication Data

US 2003/0066744 A1 Apr. 10, 2003

(30) Foreign Application Priority Data

Oct. 5, 2001 (ZA) ..... 2001/8210

(51) Int. Cl.[7] ..... H01H 3/00
(52) U.S. Cl. ..... 200/552; 200/553; 200/339
(58) Field of Search ..... 200/1 R, 1 B, 200/17 R, 18, 315, 339, 552, 553–574, 520–551, 18.315

(56) References Cited

U.S. PATENT DOCUMENTS 3,225,156 A * 12/1965 Sahrbacker ..... 200/339 X
3,680,014 A * 7/1972 Wilkinson ..... 335/26
4,323,744 A * 4/1982 Sheridan et al. ..... 200/339 X
5,130,684 A * 7/1992 Scott et al. ..... 335/43

* cited by examiner

*Primary Examiner*—James R Scott
(74) *Attorney, Agent, or Firm*—Burns, Doane, Swecker & Mathis, L.L.P.

(57) ABSTRACT

A switch actuator mechanism, for example for use with a circuit breaker, includes a rocker which has first and second rocker members which are hinged together. The rocker members have flat front faces which are movable between a condition in which they lie flat in the same plane, and a second position in which the faces are inclined relative to one another, with one rocker member standing proud of the housing of the switch or circuit breaker. Fingers on one of the rocker members engage a link of the circuit breaker mechanism to open or close its contacts. A spring loaded latching mechanism locks the rocker members alternately in their first and second conditions with successive operations of the mechanism.

14 Claims, 2 Drawing Sheets

SWITCH ACTUATOR MECHANISM

This application claims priority under 35 U.S.C. §§119 to patent application Ser. No. 2001/8210 filed in South Africa on Oct. 5, 2001, the entire content of which is hereby incorporated by reference.

BACKGROUND OF THE INVENTION

THIS invention relates to a switch actuator mechanism which can be used, for example, in circuit breakers and similar switch devices.

The use of rocker switches in circuit breakers and other switch devices is well known. Conventionally, the rocker is fitted pivotally in an opening in a front panel of the circuit breaker housing and has two lobes which define faces which are inclined at an oblique angle relative to one another. Depending on whether the circuit breaker is on or off, one or the other of the lobes extends proud of the front panel of the circuit breaker, while the front face of the other lobe lies flush with the front panel.

In some cases, it is important that the circuit breaker should not be switched off accidentally. For this reason, guards in the form of upstanding walls can be provided on either side of the rocker to prevent accidental bumping of the rocker.

It is an object of the invention to provide an alternative switch actuator mechanism.

SUMMARY OF THE INVENTION

According to the invention there is provided a switch actuator mechanism including a rocker having first and second rocker members mountable movably relative to one another on a switch housing, at least one of the first and second rocker members being connectable to a switch mechanism to operate the switch mechanism, the first and second rocker members each defining a front face and the front faces of the first and second rocker members being movable between respective first positions in which they are inclined relative to one another and respective second positions in which they are substantially parallel.

The rocker members may be designed for use with a circuit breaker and to be mounted in an opening defined in a front panel of a circuit breaker housing, so that when the front faces of the rocker members are substantially parallel, they are substantially flush with the edges of the opening. This condition preferably corresponds to an "On" condition of the circuit breaker.

Conversely, when the front faces of the first and second rocker members are in their respective first positions and are inclined relative to one another, one of the front faces is preferably substantially flush with the front panel of the circuit breaker housing, so that the other rocker member stands proud of the front panel.

Preferably, the rocker members are connectable hingedly together.

In a preferred embodiment, the first and second rocker members have front faces of different colours.

For example, the first and second rocker members can be moulded in different coloured plastics material.

DESCRIPTION OF AN EMBODIMENT

Figure 1:
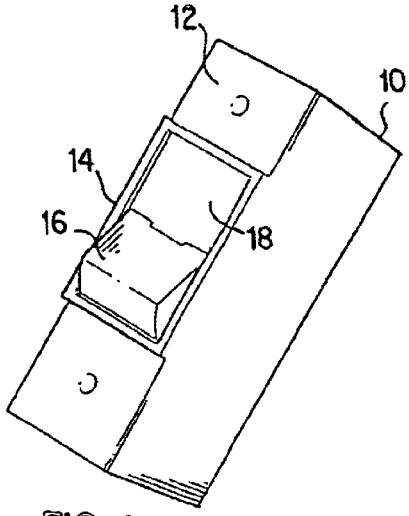
FIG. 1 is a pictorial view of a circuit breaker including a switch actuator mechanism according to the invention with its operating switch in an "Off" position.
Figure 2:
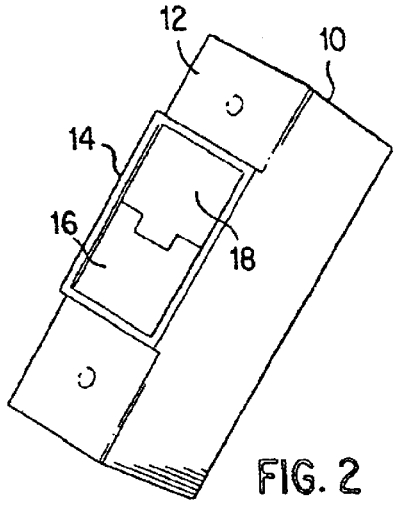
FIG. 2 is a similar view to that of FIG. 1, with the switch in an "On" position.

FIGS. 1 and 2 show a miniature circuit breaker incorporating a switch actuator mechanism according to the invention. The circuit breaker comprises a moulded plastics housing 10 which is generally conventional and which has a parallelepipedic shape. The housing has a front panel 12 with a rectangular central aperture defined by a raised border 14. Within the aperture is located a rocker comprising first and second rocker members or lobes 16 and 18 respectively. In the preferred embodiment of the invention, the rockers are moulded from different coloured plastics material (or otherwise colour coded differently) in order to distinguish which portion of the rocker switches the circuit breaker on and which switches it off. In the preferred embodiment, the lower rocker portion 16 was coloured red, while the upper portion 18 was coloured white.

In FIG. 1, the circuit breaker is in its "Off" position, and the rocker member 16 which defines the lower lobe of the rocker stands proud of the front plate 12 of the housing. The front face of the second rocker member or lobe 18 lies substantially flush with the front plate 12, recessed slightly below the upper edge of the border 14.

Figure 3:
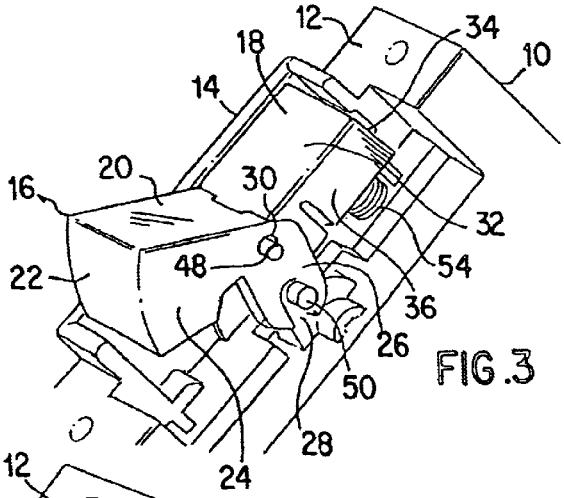
FIG. 3 is a partially cut away detail view showing the switch mechanism in the "Off" position thereof.
Figure 4:
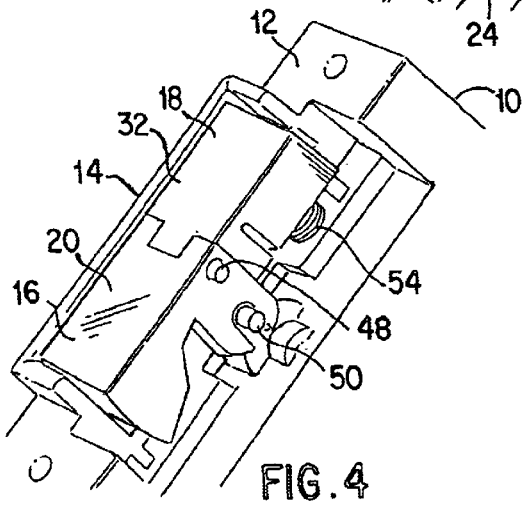
FIG. 4 is a similar view to that of FIG. 3, showing the switch mechanism in the "On" position thereof.
Figure 5:
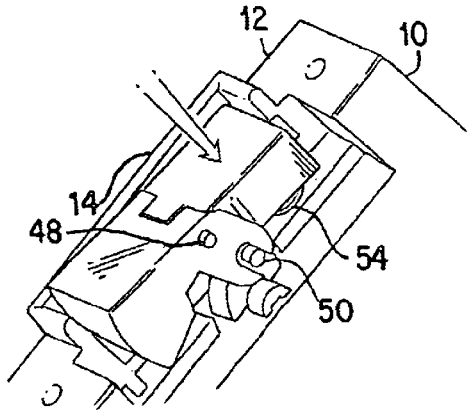
FIG. 5 is a similar view to FIGS. 3 and 4, showing how the switch is operated to return it to the "Off" position thereof.
Figure 7:
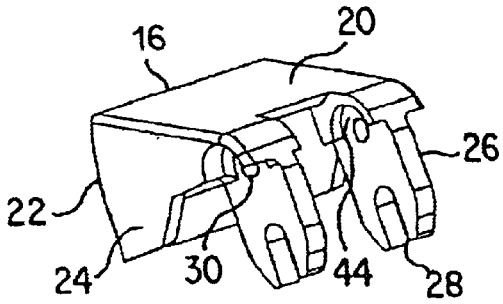
FIGS. 7 and 8 are pictorial views of first and second rocker members forming part of the switch actuator mechanism.
Figure 8:
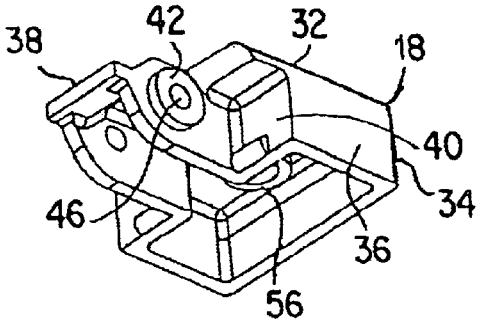

FIGS. 3 to 5 illustrate the arrangement of the switch actuator mechanism in more detail. Referring first to FIG. 3, with reference also to FIGS. 7 and 8, the first rocker member 16 has a flat front face 20, a curved end face 22, and a pair of parallel side faces 24. Depending from the side faces 24 and formed integrally therewith are a pair of fingers 26, each of which has a slot 28 at the end thereof furthest from the front face 20 and an aperture 30 at the other end thereof, adjacent the front face 20. The second actuator member is shaped complementally, with a flat front face 32, a curved end face 34 and parallel side faces 36.

A projection 38 sized to fit between the fingers 26 extends from an inner face 40 of the second rocker member, and is provided with a pair of upstanding bosses 42 which are shaped to locate in complemental recesses 44 defined in the body of the first rocker member 16 at the inner ends of the fingers 26. The bosses 42 have coaxial apertures 46 formed therein, which are aligned with the apertures 30 when the two rocker members are correctly aligned. A metal pin 48, which is held captive by the inner walls of the housing 10 when the switch mechanism is assembled, holds the two rocker members hingedly together.

Figure 6:
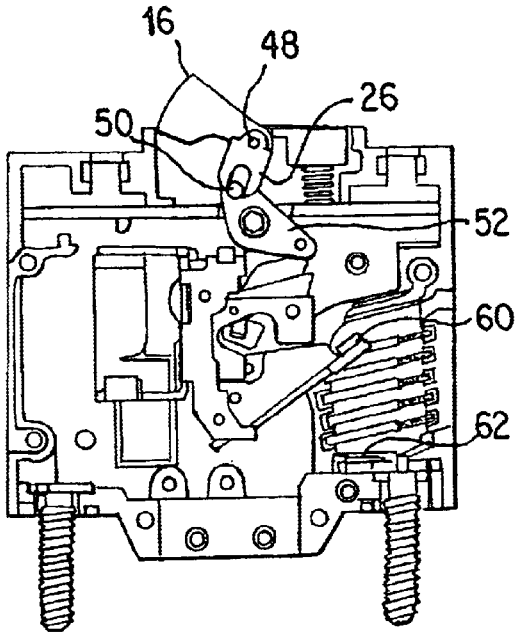
FIG. 6 is a side view of a circuit breaker incorporating the switch actuator mechanism of the invention.

As best shown in FIG. 6, the slots at the ends of the fingers 26 engage opposite ends of a pin which is carried at one end of a pivoting link member 52 forming part of a conventional circuit breaker actuating mechanism. The interaction between the rocker and the circuit breaker mechanism is conventional, and is therefore not described in great detail.

Those skilled in the art will appreciate that as the first rocker member 16 rotates about the pin 48, the ends of the fingers 26 will describe an arc, moving the end of the link member 52 carrying the pin 50 and hence operating the circuit breaker mechanism.

Referring again to FIGS. 3, 4 and 5, it can be seen that the second rocker member 18 is biased outwardly by a coil spring 54 which locates about an upstanding boss 56 formed on the inner surface of the rocker member. When the circuit breaker is switched on by depressing the first rocker member 16, a latching mechanism locks the link member 52 and therefore the first rocker member in the position shown in FIG. 4, so that the first rocker member's front face 20 is substantially parallel with the front face 32 of the second rocker member 18.

As illustrated, the two front faces lie just below the upper edge of the border 14, but it will be appreciated by those skilled in the art that the positioning of the rocker members could be varied somewhat according to aesthetic and practical considerations.

To turn the circuit breaker off, a pressure is applied to the second rocker member 18 as illustrated by the arrow in FIG. 5. This causes the second rocker member to move inwards against the urging of the spring 54 to contact the finger 26 of the first rocker member 16, releasing the latching mechanism and allowing the first rocker member 16 to return to its original position, at the same time rotating the link member 52 and opening the contacts 60, 62 of the circuit breaker.

The described circuit breaker actuating mechanism is aesthetically attractive, compact and solves the problem of inadvertent switching off of a circuit breaker due to its operating handle protruding from the casing thereof.

It will be understood by those skilled in the art that the invention can be applied to other switch mechanisms, having one or more sets of contacts, and is not limited to use with circuit breakers.

We claim:

1. A switch actuator mechanism including a rocker having first and second rocker members mountable movably relative to one another on a switch housing, at least one of the first and second rocker members being connectable to a switch mechanism to operate the switch mechanism, the first and second rocker members each defining a front face and the front faces of the first and second rocker members being movable between respective first positions in which they are inclined relative to one another and respective second positions in which they are substantially parallel.

2. A switch actuator mechanism according to claim 1 wherein the rocker members are designed for use with a circuit breaker and to be mounted in an opening defined in a front panel of a circuit breaker housing, so that when the front faces of the rocker members are substantially parallel, they are substantially flush with the edges of the opening.

3. A switch actuator mechanism according to claim 2 wherein the condition in which the front faces of the rocker members are substantially parallel corresponds to an "On" condition of the associated circuit breaker.

4. A switch actuator mechanism according to claim 2 which is arranged so that when the front faces of the first and second rocker members are in their respective first positions and are inclined relative to one another, one of the front faces is substantially flush with the front panel of the circuit breaker housing, so that the other rocker member stands proud of the front panel.

5. A switch actuator mechanism according to claim 4 wherein the condition in which the front faces of the rocker members are inclined relative to one another corresponds to an "Off" condition of the associated circuit breaker.

6. A switch actuator mechanism according to claim 1 wherein the rocker members are connectable hingedly together.

7. A switch actuator mechanism according to claim 6 wherein the first rocker member has at least one finger extending therefrom, the finger being shaped to engage with an operating member of the circuit breaker mechanism.

8. A switch actuator mechanism according to claim 7 wherein the first rocker member has a pair of fingers extending therefrom, each finger having a slot at an end thereof remote from the rocker member, the slots being shaped to receive a pin carried by said operating member of the circuit breaker mechanism.

9. A switch actuator mechanism according to claim 7 wherein the first and second rocker members are hinged together by a pin which extends through apertures in respective mating portions of the rocker members.

10. A switch actuator mechanism according to claim 7 wherein at least one of the rocker members is movable against a resilient bias element.

11. A switch actuator mechanism according to claim 1 wherein the first and second rocker members have front faces of different colours.

12. A switch actuator mechanism according to claim 11 wherein the first and second rocker members are moulded in different coloured plastics material.

13. A switch comprising a switch housing, a switch mechanism having at least one set of contacts, and a switch actuator mechanism according to claim 1, arranged so that operation of the switch actuator mechanism opens or closes the set of contacts.

14. A switch according to claim 13 wherein the switch mechanism is a circuit breaker mechanism.

* * * * *